US008354986B2

(12) United States Patent
Lin et al.

(10) Patent No.: US 8,354,986 B2
(45) Date of Patent: Jan. 15, 2013

(54) DISPLAYING METHOD

(75) Inventors: Lin Lin, Taichung (TW); Bau-Jy Liang, Hsinchu (TW); Han-Chang Lin, Taichung (TW); Chien-Yu Fan, Taichung (TW)

(73) Assignee: Wintek Corporation, Taichung (TW)

( * ) Notice: Subject to any disclaimer, the term of this patent is extended or adjusted under 35 U.S.C. 154(b) by 1335 days.

(21) Appl. No.: 12/076,680

(22) Filed: Mar. 21, 2008

(65) Prior Publication Data

US 2008/0231577 A1 Sep. 25, 2008

(30) Foreign Application Priority Data

Mar. 22, 2007 (TW) ..... 96109999 A

(51) Int. Cl.
*G09G 3/36* (2006.01)

(52) U.S. Cl. ..... 345/88; 345/698; 345/690

(58) Field of Classification Search ..... 345/87–89, 345/690, 698–699
See application file for complete search history.

(56) References Cited

U.S. PATENT DOCUMENTS

| | | | | |
|---|---|---|---|---|
| 6,243,060 | B1 | 6/2001 | Natori | |
| 2006/0139522 | A1 | 6/2006 | Chang et al. | |
| 2006/0139527 | A1* | 6/2006 | Chang et al. | 349/114 |
| 2007/0024772 | A1 | 2/2007 | Childers et al. | |
| 2008/0055519 | A1* | 3/2008 | Battersby et al. | 349/68 |

FOREIGN PATENT DOCUMENTS

| | | | |
|---|---|---|---|
| CN | 1797073 | A | 7/2006 |
| TW | 558694 | | 10/2003 |
| TW | 200630690 | A | 9/2006 |
| TW | 200707022 | A | 2/2007 |

OTHER PUBLICATIONS

Office Action issued by State Intellectual Property Office of the People's Republic of China on Jun. 5, 2009.
Office Action issued by Taiwan Intellectual Property Office on Sep. 9, 2011.

* cited by examiner

*Primary Examiner* — Seokyun Moon
(74) *Attorney, Agent, or Firm* — Bacon & Thomas, PLLC

(57) ABSTRACT

A displaying method for trans-flective type display device is provided. The pixel array of the display device has a selected pixel unit formed by three sub-pixels selected from three basic-color sub-pixels and one enhancement sub-pixel, wherein there is a reflective area within the enhancement sub-pixel. The displaying method includes the following steps. Firstly, an original image having an image data is provided to the display device. Next, when the backlight is turned off, the resolution of the original image is scaled down for obtaining an adjusted image data. Then, another pixel unit consisting of the three basic-color sub-pixels and the enhancement sub-pixel is re-selected, and the driving value of the enhancement sub-pixel is calculated according to the adjusted image data for driving the enhancement sub-pixel.

20 Claims, 4 Drawing Sheets

| | | | |
|---|---|---|---|
| $A_{11}$ | $A_{12}$ | $A_{13}$ | $A_{14}$ |
| $A_{21}$ | $A_{22}$ | $A_{23}$ | $A_{24}$ |
| $A_{31}$ | $A_{32}$ | $A_{33}$ | $A_{34}$ |
| $A_{41}$ | $A_{42}$ | $A_{43}$ | $A_{44}$ |

| | | |
|---|---|---|
| $A_{11}'$ | $A_{12}'$ | $A_{13}'$ |
| $A_{21}'$ | $A_{22}'$ | $A_{23}'$ |
| $A_{31}'$ | $A_{32}'$ | $A_{33}'$ |
| $A_{41}'$ | $A_{42}'$ | $A_{43}'$ |

DISPLAYING METHOD

This application claims the benefit of Taiwan application Serial No. 96109999, filed Mar. 22, 2007, the subject matter of which is incorporated herein by reference.

BACKGROUND OF THE INVENTION

1. Field of the Invention

The invention relates in general to a displaying method, and more particularly to a displaying method for a transflective type display device.

2. Description of the Related Art

With the rapid advancement of technology of liquid crystal display (LCD), the features of LCD such as luminance and resolution have become a focus for LCD manufacturers.

RGBW type display device is different from any other ordinary conventional RGB type LCD in that a transparent filter element is added to the existing color filter for forming a white sub-pixel. The white sub-pixel does not need additional filter material. Therefore, RGBW type LCD has higher transmission and better luminance. In recent years, both the transflective type and the reflective type RGBW type LCD have made remarkable progress. The two types of LCDs consume less power than the conventional display device, and have become mainstream LCD products.

However, when a white sub-pixel (W) is added to the original RGB pixel array, under the same distribution area of the pixels, the pixel area which originally has three three-color sub-pixels (RGB) is now has four RGBW sub-pixels, causing the aperture ratio of the pixel to decrease. Furthermore, with the increase of the white sub-pixel, a corresponding driving line for the white sub-pixel also needs to be added, causing the amount of driving lines to increase by one third of the original amount and incurring more manufacturing cost.

Under the above conditions, a modified pixel array having the same RGBW sub-pixel is provided to resolve the above problems of having a decreased aperture ratio but an increased amount of driving lines. Referring to FIG. 1A, an illustrative diagram of an improved conventional strip type pixel array is shown. As indicated in FIG. 1A, a modified strip white (MSW) type pixel array 1 includes several rows of red sub-pixels (R), green sub-pixels (G), blue sub-pixels (B), and white sub-pixels (W), wherein every consecutively connected three sub-pixels in each row form a square. Besides, two sub-pixels having the same color disposed in two neighboring rows are alternated by two sub-pixels along the arrangement direction of the pixel array. When the MSW pixel array 1 is used in a transflective type LCD, a white sub-pixel is used to display in the reflective mode. The display device with the MSW type pixel array has the transflective effect by two ways to display an image no matter the LCD is in the transmissive mode or the reflective mode. The first, a transflective board having particular light transmission rate is disposed in the white sub-pixel for allowing the backlight to penetrate through and the external light to be reflected, wherein the transmission rate is determined according to the needs of the design. The second, a reflective board having a certain ratio to the aperture of the white sub-pixel is disposed in the white sub-pixel for allowing the backlight to penetrate through and the external light to be reflected.

In the transmissive mode, the backlight is turned on and a sub-pixel rendering (SPR) method is employed to drive the sub-pixels of the MSW pixel array 1. Let the driving of the pixel unit of FIG. 1A be taken for example. Presume that the pixel unit 10 marked by bold lines is selected. When the pixel unit 10 is driven, an image data having three-color sub-pixel (RGB) values is converted into the data format of four-color sub-pixel (RGBW) values. As the pixel unit 10 lacks the white sub-pixel (W), the white sub-pixels (W) nearest to the pixel unit 10 will be driven according to the weighted value obtained through calculation to compensate the color. When the backlight is turned on, the sub-pixels of the MSW pixel array 1 driven by the sub-pixel rendering (SPR) method is capable of maintaining the resolution of the original image without adding any extra driving lines.

However, when the trans-flective type display device with the MSW type pixel array 1 is in the reflective mode (the backlight is turned off), only the white sub-pixel (W) has a reflective area, the above driving method will result in image defects. Referring to FIG. 1B, an illustrative diagram of the pixel array of FIG. 1A when the backlight is turned off is shown. As indicated in FIG. 1B, when the backlight is turned off, only the white sub-pixel (W) is able to display an image. Compared with FIG. 1A, the selected pixel unit 10 including only three-color sub-pixels (RGB) will be dark, and other pixel units including three-color sub-pixels (RGB) will be dark either. Thus, the image cannot be clearly displayed if the sub-pixel rendering (SPR) driving method is used in the reflective mode. If image processing is not performed in advance, the display device will show a zigzag image. For example, presume that the displayed image contains a text, if the dark pixel units are located at the edge of the text. Therefore, the text with zigzag edge in the image will be shown, largely reducing the display quality.

SUMMARY OF THE INVENTION

The invention is directed to a displaying method used in a transflective type display device that has the MSW type pixel array. Of the four-color sub-pixels (RGBW), the white sub-pixel (W) has a reflective area. In the transmissive mode, when the backlight is turned on, the image is displayed according to the sub-pixel rendering (SPR) method. In the reflective mode, when the backlight is turned off, the image is displayed by driving the white sub-pixel to use the reflection of an external light, not only resolving the problem of having a zigzag image but also providing the image with gray level and color gradation.

According to a first aspect of the present invention, a displaying method used in a transflective type display device whose pixel array has three basic-color sub-pixels and one enhancement sub-pixel is provided. There is a reflective area within the enhancement sub-pixel. The pixel array has a selected pixel unit formed by any three sub-pixels selected from the abovementioned four sub-pixels. The displaying method includes the following steps. Firstly, an original image having an image data is provided to the display device, wherein the image data includes the data of the three basic-color sub-pixels. Next, when the backlight of the display device is turned off, the resolution of the original image is scaled down for obtaining an adjusted image data having the data of the three basic-color sub-pixels. Then, another pixel unit consisting of the three basic-color sub-pixels and the enhancement sub-pixel is re-selected, and the driving value of the enhancement sub-pixel is calculated according to the adjusted image data for driving the enhancement sub-pixel.

According to a second aspect of the present invention, a displaying method used in a transflective type display device whose pixel array has three basic-color sub-pixels and one enhancement sub-pixel is provided. There is a reflective area within the enhancement sub-pixel. The pixel array has a selected pixel unit formed by any three sub-pixels selected from the abovementioned four sub-pixels. According to the pixel array, two neighboring sub-pixels disposed in the same row have different colors, and two sub-pixels having the same color disposed in two neighboring rows are alternated by two sub-pixels along the arrangement direction of the pixel array. The displaying method includes the following steps. Firstly, an original image having an image data is provided to the display device, wherein the original image includes the data of the three basic-color sub-pixels. Next, when the backlight of the display device is turned off, the resolution of the original image is scaled down for obtaining an adjusted image data having the data of the three basic-color sub-pixels. Then, another pixel unit consisting of the three basic-color sub-pixels and one enhancement sub-pixel is re-selected, and the driving value of the enhancement sub-pixel is calculated according to the adjusted image data for driving the enhancement sub-pixel.

The invention will become apparent from the following detailed description of the preferred but non-limiting embodiments. The following description is made with reference to the accompanying drawings.

BRIEF DESCRIPTION OF THE DRAWINGS

FIG. 3 is an illustrative diagram showing one type of selected pixel units when the backlight is turned on;

FIG. 4A is an illustrative diagram showing the data array of an original image;

DETAILED DESCRIPTION OF THE INVENTION

Figure 1A:
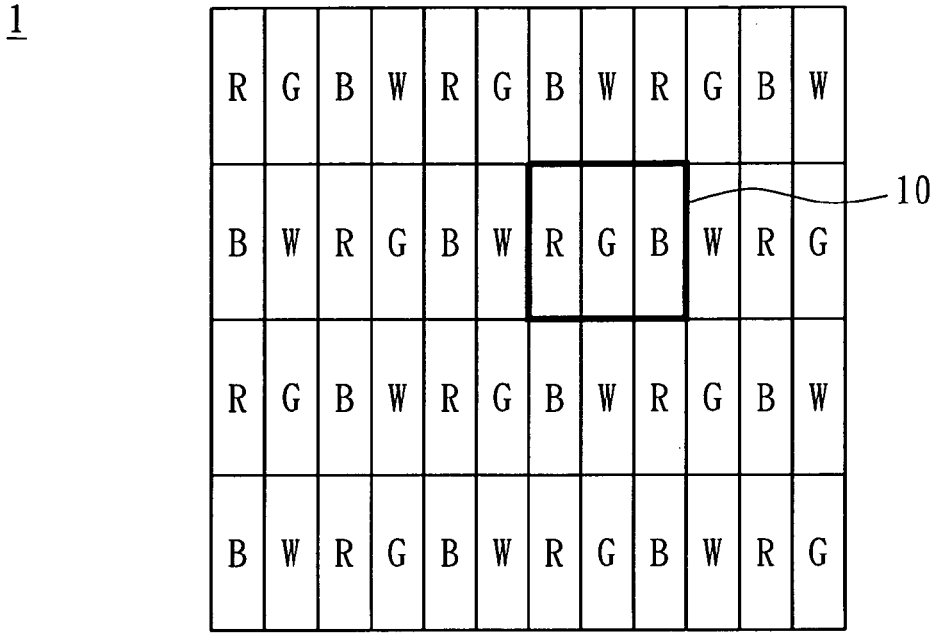
FIG. 1A(PRIOR ART)
FIG. 1A is an illustrative diagram of an improved conventional strip type pixel array.
Figure 1B:
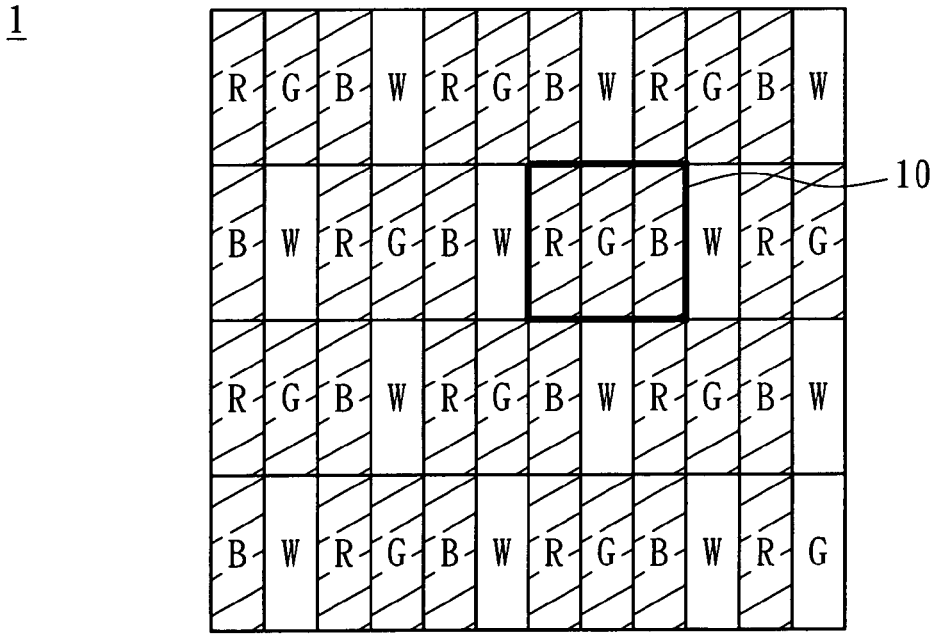
FIG. 1B(PRIOR ART)
FIG. 1B is an illustrative diagram of the pixel array of FIG. 1A when the backlight is turned off.
Figure 2:
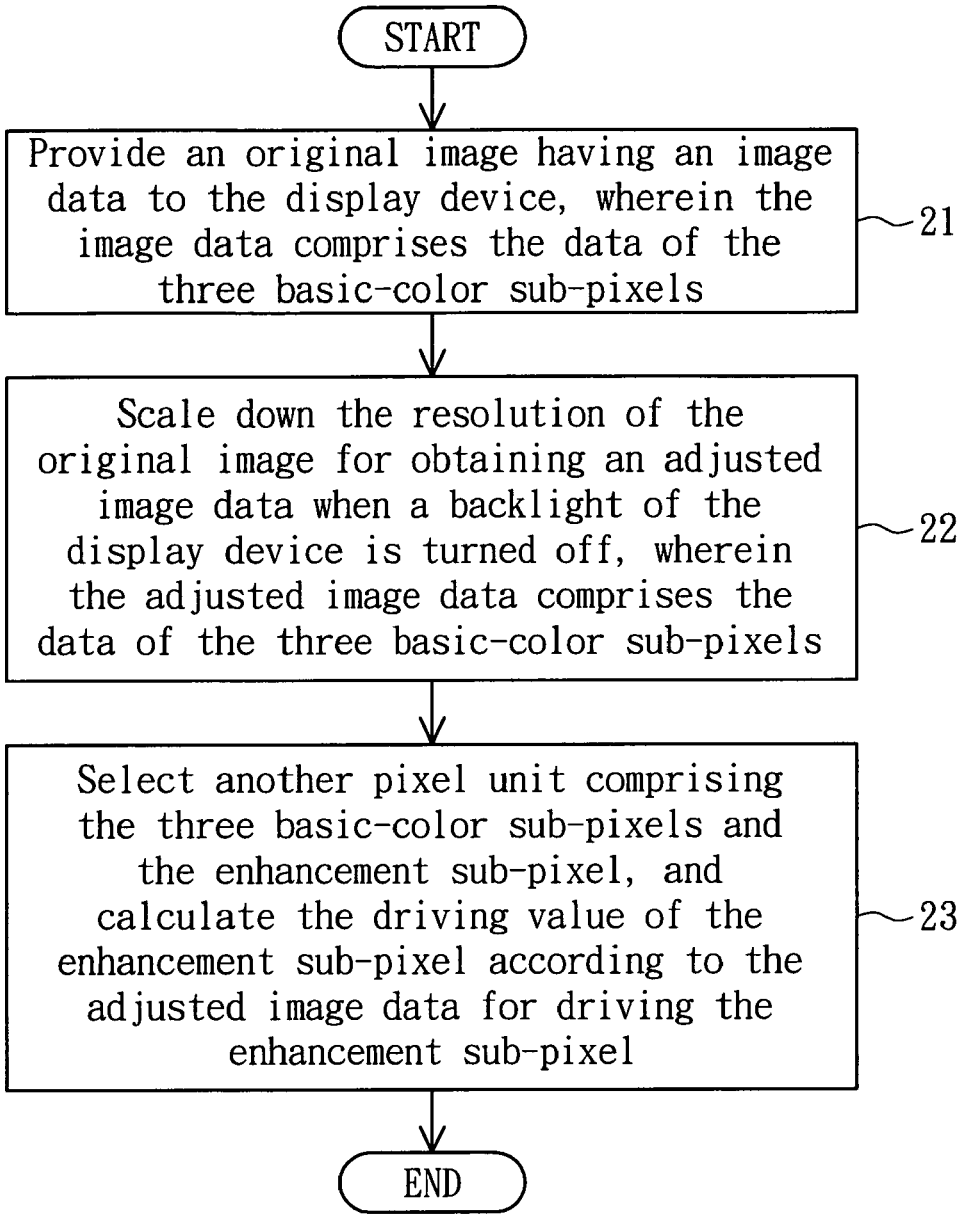
FIG. 2 is a flowchart of a displaying method according to an embodiment of the invention.

Referring to FIG. 2, a flowchart of a displaying method according to an embodiment of the invention is shown. The displaying method is used in a transflective type display device whose pixel array has at least three basic-color sub-pixels and one enhancement sub-pixel for enhancing brightness. There is a reflective area within the enhancement sub-pixel. Besides, any three sub-pixels selected from the abovementioned four sub-pixels are identified as a selected pixel unit. As indicated in FIG. 2, the displaying method includes steps 21~23. Firstly, as indicated in step 21, an original image having an image data of the three basic-color sub-pixels, such as RGB data, is provided to the display device. Next, as indicated in step 22, when the backlight is turned off, the resolution of the original image is scaled down for obtaining an adjusted image data having the data of the three basic-color sub-pixels. Then, as indicated in step 23, a pixel unit consisting of the three basic-color sub-pixels and the enhancement sub-pixel is re-selected, and the driving value of the enhancement sub-pixel is calculated according to the adjusted image data for driving the enhancement sub-pixel.

The pixel array in the embodiment is modified stripe white (MSW) type pixel array. It includes a plurality rows formed by three basic-color sub-pixels and one enhancement sub-pixel, wherein two neighboring sub-pixels disposed in the same row have different colors, and two sub-pixels having the same color but disposed in two neighboring rows are alternated by two sub-pixels along the arrangement direction of the pixel array. In the present embodiment, the three basic-color sub-pixels are exemplified by a red sub-pixel (R), a green sub-pixel (G) and a blue sub-pixel (B), and the enhancement sub-pixel is exemplified by a white sub-pixel (W). The sizes of the sub-pixels in the MSW array are substantially the same, and every three consecutively connected sub-pixels disposed in one row form a square. Besides, each of the above-mentioned sub-pixels is driven directly by an independent channel.

The transflective type display device in the present embodiment of the invention displays an image by a white sub-pixel (W) in the reflective mode. Therefore, only the white sub-pixel (W) has a reflective area. For the white sub-pixel to display both in the transmissive mode (normal mode) and the reflective mode, normally a transflective board or a reflective board is disposed in the white sub-pixel. The transflective board has a predetermined transmission rate for a part of the light to pass through the white sub-pixel. As to the reflective board, it is as big as the aperture of the white sub-pixel for reflecting an external light.

Figures 3, 4A:
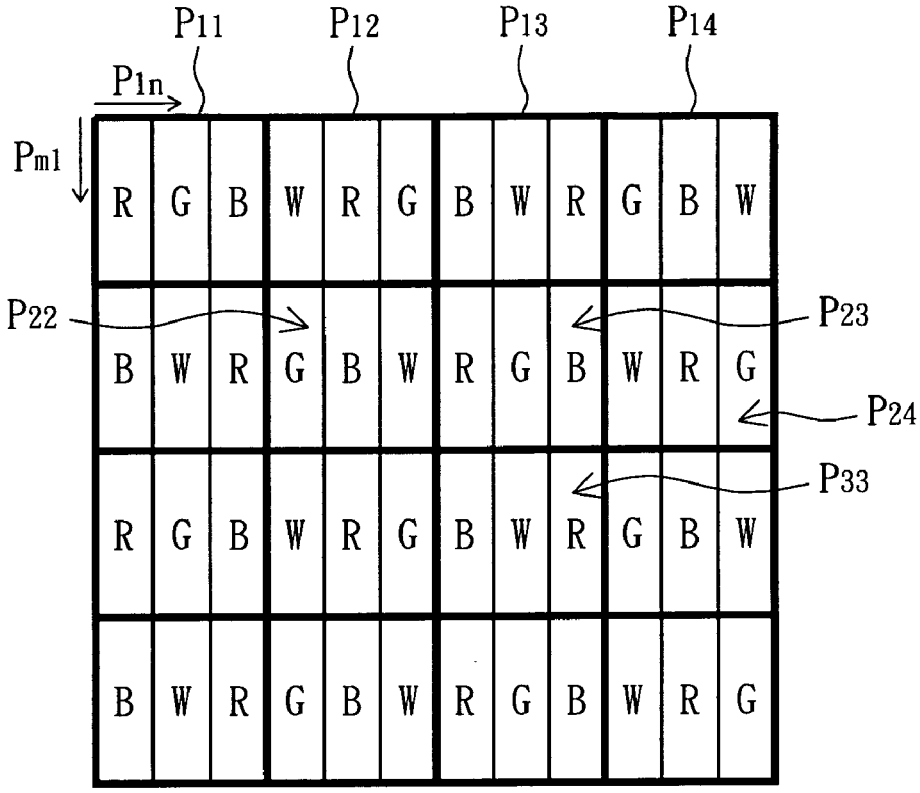

FIG. 3 is an illustrative diagram showing one type of selected pixel units when the backlight is turned on. As indicated in FIG. 3, the selected pixel unit is formed by any three sub-pixels selected from the red sub-pixel (R), the green sub-pixel (G), the blue sub-pixel (B) and the white sub-pixel (W). The colors of sub-pixels of every two row are arranged in the order of RGBW or BWRG sequentially, so that two sub-pixels having the same color disposed in two neighboring rows are alternated by two sub-pixels along the arrangement direction of the pixel array. Examples of the selected pixel unit $P_{mn}$ include pixel unit $P_{11}$ (RGB), pixel unit $P_{12}$ (WRG), pixel unit $P_{13}$ (BWG) and pixel unit $P_{14}$ (GBW). The displaying method for the MSW type pixel array is disclosed below.

FIG. 4A is an illustrative diagram showing the data array of an original image. As indicated in FIG. 4A, the original image includes several image pixel data $A_{ij}$ arranged in a matrix. Each image pixel data $A_{ij}$ has the data of the three basic-color sub-pixels, that is, the data $A_{ij}$ includes the gray level values of the red sub-pixel (R), the green sub-pixel (G) and the blue sub-pixel (B). As a pixel unit $P_{mn}$ is not necessarily formed by the red sub-pixel (R), the green sub-pixel (G) and the blue sub-pixel (B) (referring to FIG. 3), an image processing has to be applied to the original image before displaying the image. The image processing procedure is sated below.

When the backlight of the display device is turned on, a sub-pixel rendering (SPR) method for image processing is applied to the image pixel data $A_{ij}$ (i=1~4, j=1~4 for example) of the pixel array of FIG. 3 for converting the original three-color image data (RGB) into a four-color image data having RGBW gray level values. The image pixel data $A_{ij}$ (i=1~4, j=1~4) respectively correspond to the pixel unit $P_{mn}$ (m=1~4, n=1~4) of FIG. 3 and further let the image pixel data $A_{23}$ be taken for example. The selected pixel unit corresponding to the image pixel data $A_{23}$ in FIG. 3 is the pixel unit $P_{23}$ that has three-color sub-pixels (RGB). The data of the image pixel data $A_{23}$ is converted into a four-color RGBW data from a three-color RGB data. As the pixel unit $P_{23}$ lacks a white sub-pixel (W), the color of the absent sub-pixel (W) of the pixel unit $P_{23}$ will be compensated by the nearest pixel units of the pixel unit $P_{23}$. That is, the color of the absent sub-pixel (W) is compensated by the white sub-pixels (W) of the pixel unit $P_{13}$ (BWR), the pixel unit $P_{22}$ (GBW), the pixel unit $P_{33}$ (BWR) and the pixel unit $P_{24}$ (GBW). Compared with the three-color sub-pixels (RGB) of the pixel unit $P_{23}$, W is an extra gray level value that can be outputted to the white sub-pixels of the surrounding pixel units. However, when conflict occurs between the operation of the pixel unit $P_{23}$ and the operation of another selected pixel unit, such as the pixel unit $P_{24}$, the actual driving value of the sub-pixels of the pixel unit $P_{23}$ is determined according to a predetermined weighted value. Similarly, the absent colors of other pixel units such as pixel units $P_{12}$ and $P_{22}$, are compensated by the sub-pixels of nearest pixel units.

That is, when the backlight of the display device is turned on, the image data of the three basic-color sub-pixels is first converted into four-color values, wherein the four-color values include a first value of the sub-pixel color belonging to the selected pixel unit and a second value of the sub-pixel color not belonging to the selected pixel unit. Next, a third value of the sub-pixel color belonging to the selected pixel unit is inputted from several neighboring pixel units surrounding the selected pixel unit. Then, the coefficient of correlation between the first value and the third value is calculated for determining the actual driving value of each sub-pixel of the selected pixel unit. When the selected pixel unit is formed by the three basic-color sub-pixels, the second value is the driving value of the enhancement sub-pixel. When the selected pixel unit is formed by two of the three basic-color sub-pixels plus the enhancement sub-pixel, the second value is the driving value of the basic-color sub-pixel not belonging to the selected pixel unit.

When the backlight is turned on, a selected pixel unit is formed by three sub-pixels chosen from three basic-color sub-pixels (such as sub-pixels (RGB)) and one enhancement sub-pixel (W). When the backlight is turned off and only the white sub-pixels illuminate, the selected pixel units only consisting of the three-color sub-pixels (RGB), such as the pixel units $P_{11}$ and $P_{23}$, will not illuminate. Therefore, when the backlight is turned off, the processing steps of the displaying method of the embodiment are disclosed in steps 22~23 of FIG. 2. Firstly, the resolution of the original image is scaled down for obtaining an adjusted image data. Then, a pixel unit consisting of the three basic-color sub-pixels and the enhancement sub-pixel is selected, and the driving value of the enhancement sub-pixel of the pixel unit is calculated according to the above adjusted image data for driving the enhancement sub-pixel.

Figures 4B, 5:
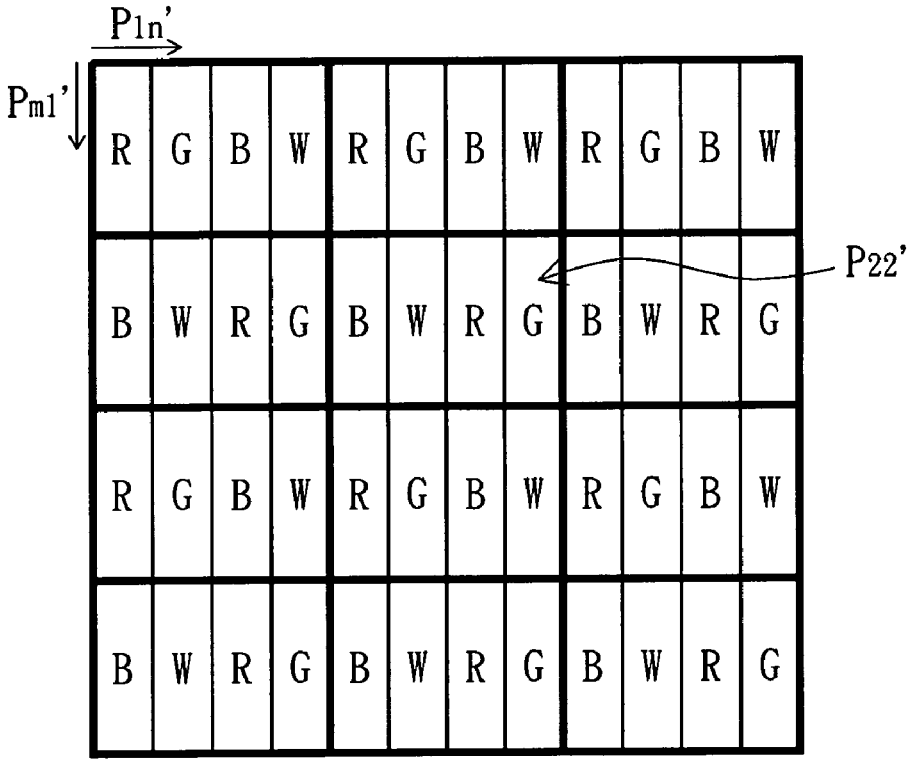
FIG. 4B is an illustrative diagram showing the adjusted image converted from the original image of FIG. 4A.
FIG. 5 is an illustrative diagram showing another type of selected pixel units when the backlight is turned off.

Referring to FIG. 4B~5, FIG. 4B is an illustrative diagram showing the adjusted image converted from the original image of FIG. 4A, and FIG. 5 is an illustrative diagram showing another type of selected pixel units with the backlight being turned off. As indicated in FIG. 5, when the backlight is turned off, each selected pixel unit $P_{mn}'$ (m=1~4, n=1~3) includes three basic-color sub-pixels (RGB) and one enhancement sub-pixel (W). As the data of the selected pixel units $P_{mn}'$ is not identical with the original image data (referring to FIG. 4A), the resolution of the original image must be adjusted. Because the number of sub-pixels of each pixel unit is converted from three to four, the number of pixel units $P_{mn}'$ in each row is reduced by a quarter compared with number of the original pixel units $P_{mn}$ (shown in FIG. 3). Under such circumstances, the resolution of the original image must be adjusted accordingly. Comparing FIG. 4A with FIG. 5, the number of pixels of the original image must be reduced by one quarter in the horizontal direction. That is, the resolution S1 of the original image must be reduced by one quarter, and the original image pixel data $A_{ij}$ (i=1~4, j=1~4) needs to be adjusted accordingly. As indicated in FIG. 4B, the resolution S2 of the adjusted image having the pixel data $A_{ij}'$ (i=1~4, j=1~3) is equal to three quarters of the resolution S1 of the original image having the pixel data $A_{ij}$ (i=1~4, j=1~4). The relationship between the resolution S1 and S2 is expressed as: S2=(¾)×S1. After the resolution of original image as shown in FIG. 4A is scaled down to an adjusted resolution as shown in FIG. 4B, each pixel unit $P_{mn}'$ corresponds to an adjusted image pixel data $A_{ij}'$ for displaying. Each adjusted image pixel data $A_{ij}'$ includes the data of three basic-color sub-pixels (that is, the three-color sub-pixels (RGB)).

When the backlight is turned off, only the white sub-pixel (W) of the pixel unit $P_{mn}'$ is able to display. Therefore, the driving value of the white sub-pixel (W) of the pixel unit $P_{mn}'$ has to be determined according to the adjusted image pixel data $A_{ij}'$. The adjusted image pixel data $A_{ij}'$ includes the data of the red sub-pixel (R), the green sub-pixel (G) and the blue sub-pixel (B), and the driving value of the white sub-pixel (W) is obtained by using an algorithm of the data of the above three sub-pixels (RGB). The driving value Wd of the white sub-pixel (W) is obtained from the formula:

$$Wd=P1\times C1+P2\times C2+P3\times C3,$$

wherein, C1 is the gray level value of the red sub-pixel (R), C2 is the gray level value of the green sub-pixel (G), C3 is the gray level value of the blue sub-pixel (B), P1 is the weighted value of the red sub-pixel (R), P2 is the weighted value of the green sub-pixel (G), and P3 is the weighted value of the blue sub-pixel (B). The sum of the weighted values P1, P2 and P3 is substantially equal to 1.

Let the selected pixel unit $P_{22}'$ (BWRG) be taken for example. As the adjusted image pixel data $A_{22}'$ includes the gray level values $R_{22}$, $G_{22}$ and $B_{22}$ of the red sub-pixel (R), the green sub-pixel (G) and the blue sub-pixel (B) for driving the red sub-pixel (R), the green sub-pixel (G) and the blue sub-pixel (B), according to the formula for calculating the driving value of the white sub-pixel (W), the driving value $W_{22}$ or the gray level value of the white sub-pixel (W) is obtained from the formula: $W_{22}=P1\times R_{22}+P2\times G_{22}+P3\times B_{22}$. The white sub-pixel driving values for other selected pixel units are obtained by the same way.

As human eyes are more sensitive to the change in the gray level than the change in the tone of the color, the weighted values P1~P3 of the red sub-pixel, the green sub-pixel and the blue sub-pixel are different so as to generate the color gradation of the image. Preferably, when the P1 is substantially equal to 0.299, P2 is substantially equal to 0.587, and P3 is substantially equal to 0.114, the displayed image has gray level and great gradation of colors. In other embodiment, others weighted values can be used according to the desired display effect of a display device.

When the backlight is turned off, the transflective type display device with the MSW type pixel array using the displaying method in the FIG. 2 can drive the white sub-pixel in each re-selected pixel unit effectively. Therefore, the display device can display an image faithfully and avoid the zigzag problem which occurs when a part of pixel points do not illuminate.

According to the displaying method disclosed in the above embodiment of the invention, when the backlight of a transflective type display device is turned off, an image processing is applied to the original image for scaling down the resolution of the original image; then, a pixel unit consisting of three basic-color sub-pixels and one enhancement sub-pixel is re-selected. The driving value of the enhancement sub-pixel is calculated according to the adjusted image data for driving the enhancement sub-pixel. As a result, the problem of displaying a zigzag image is resolved, and the displayed image has great color gradation of and gray level.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A displaying method used in a transflective type display device whose pixel array has three basic-color sub-pixels and one enhancement sub-pixel, wherein there is a reflective area within the enhancement sub-pixel, the pixel array has a first selected pixel unit formed by any three sub-pixels selected from the abovementioned four sub-pixels, the displaying method comprises:

providing an original image having an image data to the display device, wherein the image data comprises the data of the three basic-color sub-pixels;

scaling down the resolution of the original image according to a second selected pixel unit consisting of the three basic-color sub-pixels and the enhancement sub-pixel for obtaining an adjusted image data when a backlight of the display device is turned off, wherein the adjusted image data comprises the data of the three basic-color sub-pixels; and calculating the driving value of the enhancement sub-pixel according to the adjusted image data for driving the enhancement sub-pixel;

wherein the original image has a first resolution S1, the adjusted original image has a second resolution S2, and the relationship between S1 and S2 is expressed as: S2=(n/m)×S1, where n is the number of sub-pixels of the first selected pixel unit and m is the number of sub-pixels of the second selected pixel unit.

2. The displaying method according to claim 1, wherein the relationship between S1 and S2 is expressed as: S2=(¾)×S1.

3. The displaying method according to claim 1, the driving value Wd of the enhancement sub-pixel expressed as: Wd=P1×C1+P2×C2+P3×C3, wherein C1, C2 and C3 respectively are the gray level values of the data of the three basic-color sub-pixels, P1, P2 and P3 respectively are the weighted values of the three basic-color sub-pixels, and the sum of P1, P2 and P3 is substantially equal to 1.

4. The displaying method according to claim 3, wherein P1 is substantially equal to 0.299, P2 is substantially equal to 0.587, and P3 is substantially equal to 0.114.

5. The displaying method according to claim 1, further comprising:

converting the data of the three basic-color sub-pixels of the image data into four-color data values when the backlight of the display device is turned on, wherein the four-color data values comprise a first value of the sub-pixel color belonging to the selected pixel unit and a second value of the sub-pixel color not belonging to the selected pixel unit;

inputting a third value of the sub-pixel color belonging to the selected pixel unit from a plurality of neighboring pixel units surrounding the selected pixel unit; and calculating the coefficient of correlation between the first value and the third value for determining the actual driving value of each sub-pixel of the selected pixel unit.

6. The displaying method according to claim 5, wherein when the selected pixel unit is formed by the three basic-color sub-pixels, the second value is the driving value of the enhancement sub-pixel.

7. The displaying method according to claim 5, wherein when the selected pixel unit is formed by two of the three basic-color sub-pixels plus the enhancement sub-pixel, the second value is the driving value of the basic-color sub-pixel not belonging to the selected pixel unit.

8. The displaying method according to claim 1, wherein the three basic-color sub-pixels respectively are a red sub-pixel, a green sub-pixel and a blue sub-pixel, the enhancement sub-pixel is a white sub-pixel.

9. The displaying method according to claim 1, wherein the pixel array comprises a plurality of rows formed by the three basic-color sub-pixels and the enhancement sub-pixel, two neighboring sub-pixels disposed in the same row have different colors, and two sub-pixels having the same color disposed in two neighboring rows are alternated by two sub-pixels along the arrangement direction of the pixel array.

10. The displaying method according to claim 9, wherein the sizes of the sub-pixels of the pixel array are substantially the same.

11. The displaying method according to claim 9, wherein every three consecutively connected sub-pixels in the rows of the pixel array form a square.

12. A displaying method used in a trans-flective type display device whose pixel array has three basic-color sub-pixels and one enhancement sub-pixel, wherein the pixel array has a first type of selected pixel unit formed by any three sub-pixels selected from the abovementioned four sub-pixels, there is a reflective area within the enhancement sub-pixel, and in the pixel array, two neighboring sub-pixels disposed in the same row have different colors, and two sub-pixels having the same color disposed in two neighboring rows are alternated by two sub-pixels along the arrangement direction of the pixel array, the displaying method comprising:

providing an original image having an original data to the display device, wherein the image data comprises the data of the three basic-color sub-pixels;

scaling down the resolution of the original image according to a second type of selected pixel unit consisting of the three basic-color sub-pixels and the enhancement sub-pixel for obtaining an adjusted image data when a backlight of the display device is turned off, wherein the adjusted image data comprises the data of the three basic-color sub-pixels; and calculating the driving value of the enhancement sub-pixel according to the adjusted image data for driving the enhancement sub-pixel;

wherein the original image has a first resolution S1, the adjusted original image has a second resolution S2, and the relationship between S1 and S2 is expressed as: S2=(/3;4)×S1.

13. The displaying method according to claim 12, wherein the driving value of the enhancement sub-pixel is Wd, and Wd=P1×C1+P2×C2+P3×C3, C1, C2 and C3 respectively are the gray level values of the data of the three basic-color sub-pixels, P1, P2 and P3 respectively are the weighted values of the three basic-color sub-pixels, and the sum of P1, P2 and P3 is substantially equal to 1.

14. The displaying method according to claim 13, wherein P1 is substantially equal to 0.299, P2 is substantially equal to 0.587, and P3 is substantially equal to 0.114.

15. The displaying method according to claim 12, further comprising:

converting the data of the three basic-color sub-pixels of the image data into four-color values when the backlight of the display device is turned on, wherein the four-color values comprise a first value of the sub-pixel color belonging to the selected pixel unit and a second value of the sub-pixel color not belonging to the selected pixel unit;

inputting a third value of the sub-pixel color belonging to the selected pixel unit from a plurality of neighboring pixel units surrounding the selected pixel unit; and calculating the coefficient of correlation between the first value and the third value for determining the actual driving value of each sub-pixel of the selected pixel unit.

16. The displaying method according to claim 15, wherein when the selected pixel unit is formed by the three basic-color sub-pixels, the second value is the driving value of the enhancement sub-pixel .

17. The displaying method according to claim 15, wherein when the selected pixel unit is formed by two of the three basic-color sub-pixels plus the enhancement sub-pixel, the second value is the driving value of the basic-color sub-pixel not belonging to the selected pixel unit.

18. The displaying method according to claim 12, wherein the three basic-color sub-pixels respectively are a red sub-pixel, a green sub-pixel and a blue sub-pixel, the enhancement sub-pixel is a white sub-pixel.

19. The displaying method according to claim 12, wherein the sizes of the sub-pixels of the pixel array are substantially the same.

20. The displaying method according to claim 12, wherein every three consecutively connected sub-pixels in the rows of the pixel array form a square.

* * * * *